US005088378A

United States Patent [19]

DeLaTorre

[11] Patent Number: 5,088,378

[45] Date of Patent: Feb. 18, 1992

[54] METHOD OF ADAPTING A TYPEWRITER KEYBOARD TO CONTROL THE PRODUCTION OF MUSIC

[76] Inventor: Marcus M. DeLaTorre, 4119 W. Missouri Ave., Phoenix, Ariz. 85019

[21] Appl. No.: 615,175

[22] Filed: Nov. 19, 1990

[51] Int. Cl.[5] ..... G10H 1/00

[52] U.S. Cl. ..... 84/470 R; 84/715; 84/DIG. 22; 84/423 R

[58] Field of Search ..... 84/423 R, 423 B, 470 R, 84/600, 613, 619, 615, 443, 445, DIG. 22, 715

[56] References Cited

U.S. PATENT DOCUMENTS

| | | | |
|---|---|---|---|
| 2,159,491 | 5/1939 | Rose . | |
| 2,432,527 | 12/1947 | Lang . | |
| 2,780,127 | 2/1957 | Hennick | 84/404 |
| 3,055,252 | 9/1962 | Marsich . | |
| 3,093,911 | 6/1963 | Hagelstein et al. . | |
| 3,845,684 | 11/1974 | Herr . | |
| 4,031,800 | 6/1977 | Thompson . | |
| 4,226,154 | 10/1980 | Easler . | |
| 4,350,070 | 9/1982 | Bahu . | |
| 4,352,313 | 10/1982 | Ny . | |
| 4,499,807 | 2/1985 | Ishida | 84/DIG. 22 |
| 4,646,609 | 3/1987 | Teruo et al. | 84/DIG. 7 |
| 4,655,117 | 4/1987 | Roose . | |
| 4,704,940 | 11/1987 | Cummings | 84/423 R |

OTHER PUBLICATIONS

"Great Music of the World", By Mangus Organ Corp., Linden, N.J., 1972, pp. 253–256.

*Primary Examiner*—William M. Shoop, Jr.
*Assistant Examiner*—Helen Kim
*Attorney, Agent, or Firm*—Lowell W. Gresham; Don J. Flickinger; Jordan M. Meschkow

[57] ABSTRACT

A method of adapting a keyboard musical instrument to produce sound in response to the activation of keys included in a typewriter keyboard is disclosed. A standard typewriter keyboard is coupled to a conventional electronic sound generation platform in lieu of or in addition to a standard piano keyboard. Musical chords are assigned to keys typically operated by a user's left hand. Forty-eight chords are producible by multiplexing each of 24 keys located on the left side of the keyboard to produce one of two possible chords. The selection of the one of two possible chords is performed in response to manipulation of the left shift key. Melody notes are assigned to keys typically operated by a user's right hand. Thirty-one melody notes are assigned to 26 keys located on the right side of the typewriter keyboard. Thus, five of the 26 keys are multiplexed to produce one of two possible melody notes, selectable through operation of the right shift key. The melody note keys are latched so that once a melody note has been initiated, it continues until another melody note key is activated. Alternatively, operation of the spacebar silences a melody note. When a single melody note is repeated, a momentary silence period is automatically inserted prior to initiation of the repeated note.

27 Claims, 6 Drawing Sheets

METHOD OF ADAPTING A TYPEWRITER KEYBOARD TO CONTROL THE PRODUCTION OF MUSIC

TECHNICAL FIELD OF THE INVENTION

The present invention relates generally to electronic musical instruments. More specifically, the present invention relates to such instruments in which the production of music is controlled by the manual operation of keys or switches.

BACKGROUND OF THE INVENTION

Conventional keyboard instruments, such as pianos, organs, synthesizers, and the like, are difficult to master. In addition to basic musical talents, they require learned musical skills, and an exceptional amount of manual dexterity and coordination. Consequently, musicians typically master such instruments only after many years of hard work and practice. In particular, mastery of such instruments comes almost exclusively to those who take up the instrument and follow a rigorous practice schedule during their childhood years. The difficulty associated with mastering such instruments poses a chilling and intimidating effect on adults and those who have not yet mastered the instrument but nevertheless like to experience some degree of success in using such instruments to play popular music.

The difficulty in adapting keyboard instruments so that musical novices and amateurs may experience the joys associated with successfully playing their own music have been widely recognized. Hence, many modern electronic keyboards, organs, pianos, and synthesizers are complex, computer controlled machines. These machines automatically produce a wide variety of sounds, rhythms, and accompaniments so that pleasant sounding music may be more easily produced by a user. However, a user is still generally required to master the basic piano-style keyboard. Keyboard mastery requires the user to: 1) associate musical notes, chords, and the like with corresponding keyboard keys, 2) know precisely where each of the keys is located on the keyboard, and 3) press appropriate keys in real time.

Various alternate musical notation schemes have been devised to help a user master the basic piano-style keyboard. For example, colors, numbers, or alphabetical musical notes are occasionally printed on the keys. A musical notation system describing music to be played then employs the colors, numbers, and alphabetical musical notes that are printed on the keys. Such systems allow a user to use a familiar information carrying code (colors, numbers, alphabetic letters) rather than standard musical notation so that the user initially needs to learn fewer new concepts. While such schemes may help a user associate musical notes, chords, and the like with corresponding keys on a piano-style keyboard, they do nothing to help a user learn precisely where each key is located. Consequently, such schemes are largely unsuccessful in aiding a novice or amateur musician to successfully play music.

In an attempt to help a novice or amateur musician successfully play music on a keyboard instrument, various typewriter keyboard instruments have been devised. Such instruments attempt to exploit the existing knowledge that is shared by a vast number of persons concerning the precise location of each of the keys on a typewriter keyboard, such as is commonly used with typewriters and computers. In theory, this typewriter keyboard knowledge, when optionally coupled with an alternate musical notation scheme, should go a long way toward helping a novice or amateur musician to successfully play music.

However, conventional typewriter keyboard musical instruments fail in their efforts because they do not adapt the method of using a typewriter keyboard to the production of music. For example, the levels of typing skill vary considerably from accomplished touch-typists to those who use the single finger "hunt-and-peck" method. Thus, those conventional typewriter keyboard musical instruments that require its users to be accomplished touch-typists have little to offer lesser-skilled typists.

Additionally, typists typically press only one key at a time. Thus, conventional typewriter keyboard musical instruments that require a user to simultaneously hold down more than one key at a time, particularly with one hand, are awkward for a typist because they call upon the typist to operate the keyboard in opposition to the typist's habits and training.

Typists typically refrain from holding a key down for any longer than the minimal time needed for a typewriter or computer to recognize that the key has been pressed. In fact, on most electric typewriters and computers, continued pressing on a key automatically simulates repeated actuations of the key. Accordingly, conventional typewriter keyboard musical instruments that require a user to hold down a key for relatively long periods of time are again awkward for a typist to use because they call upon the typist to operate the keyboard in opposition to the typist's habits and training.

Furthermore, a typist typically activates keys located on the right side of a typewriter keyboard using only the right hand and activates keys located on the left side of the keyboard using only the left hand. Thus, the typewriter keyboard is divided into left and right sides to a typist. Conventional typewriter keyboard musical instruments that intermingle the key functions, such as chord keys and melody note keys, between left and right sides of the typewriter keyboard are also awkward for a typist to use because they call upon the typist to intermingle key functions between the typist's left and right hands.

SUMMARY OF THE INVENTION

Accordingly, it is an advantage of the present invention that an improved method adapting a typewriter keyboard to produce music is provided.

Another advantage of the present invention is that a method of producing chords from the activation of a single key of a typewriter keyboard is provided.

Yet another advantage is that the present invention provides a method of producing chord sounds in response to the activation of keys located on one side of a typewriter keyboard and melody note sounds in response to the activation of keys located on the other side of the typewriter keyboard.

Still another advantage is that the present invention provides a method of continuing sounds initiated in response to activation of a typewriter keyboard key after the key has been deactivated.

The above and other advantages of the present invention are carried out in one form by a method of emitting tones in response to the activation of various keys included on a typewriter keyboard. The keyboard has a first-hand set of keys and a second-hand set of keys. If the first-hand set of keys is the left-hand set of keys, then the second-hand set of keys is the right-hand set of keys, and vice-versa. The method calls for monitoring the keys included in the first-hand and second-hand sets of keys to determine when they are activated and deactivated. A chord is generated when any key from the first-hand set of keys is activated. The chord results from a combination of at least two of the tones. A melody note is produced when any key from the second-hand set of keys is activated. The melody note represents a single one of the tones.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and:

DETAILED DESCRIPTION OF THE PREFERRED EMBODIMENTS

Figure 1A:
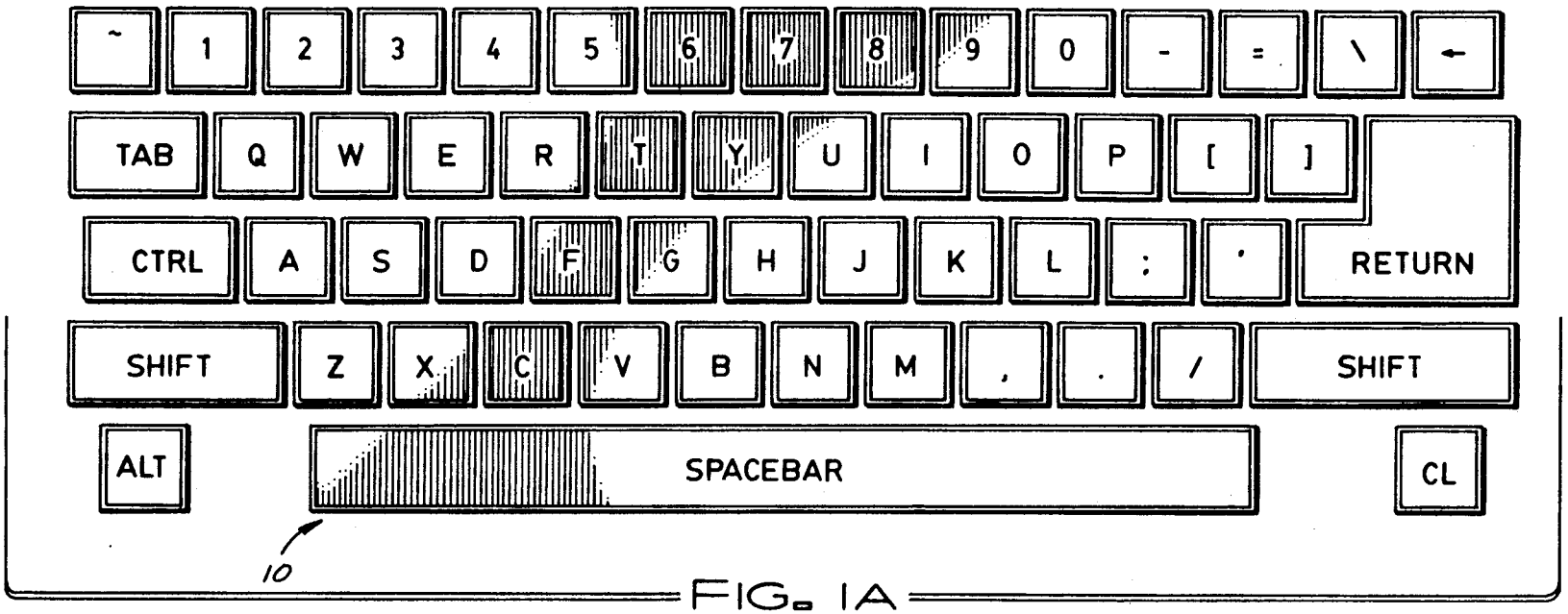
FIG. 1A shows an exemplary typewriter keyboard which serves as a component of the present invention.
Figure 1B:
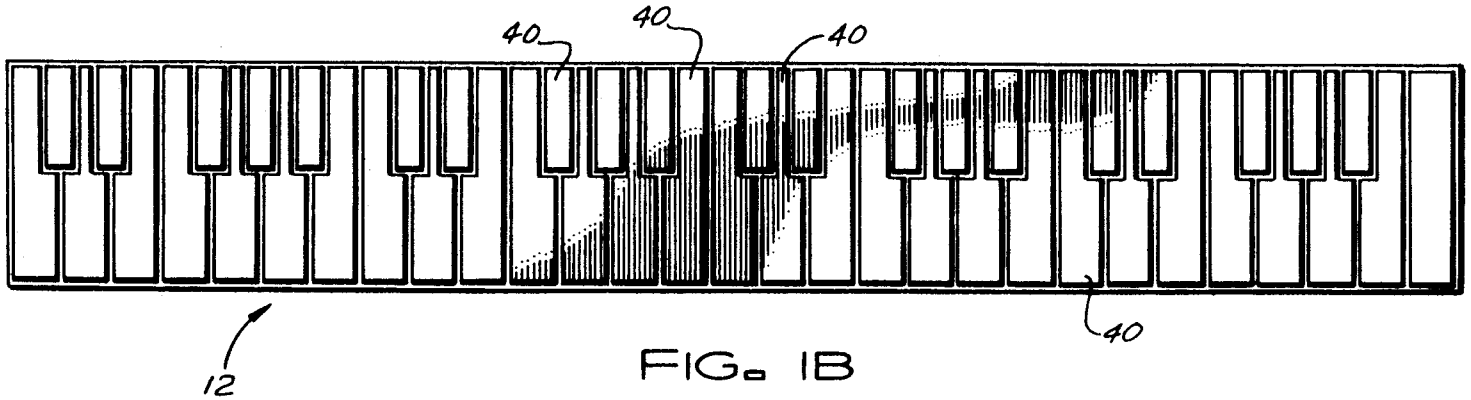
FIG. 1B shows an exemplary piano-style keyboard which optionally serves as a component of the present invention.
Figure 4:
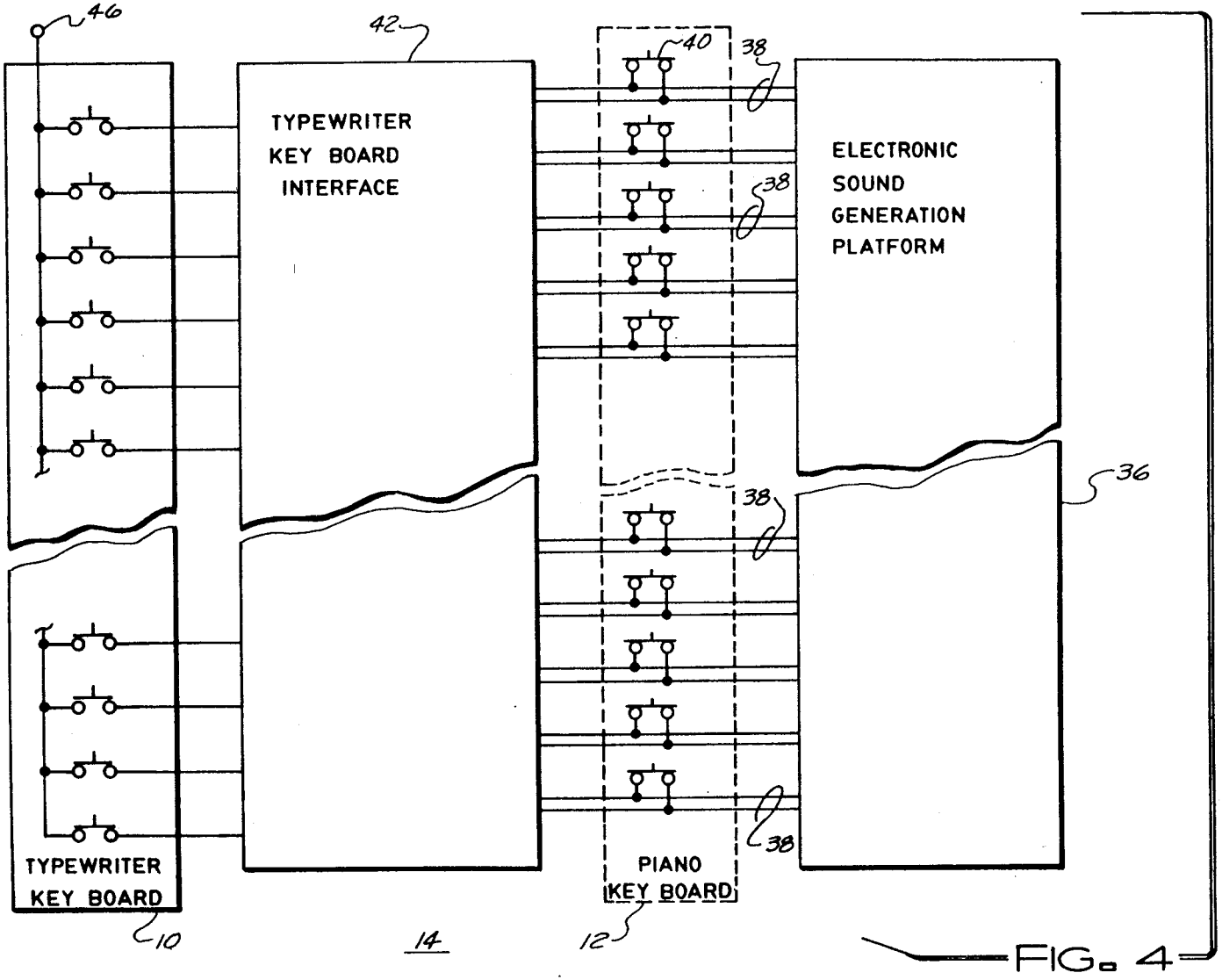
FIG. 4 shows a block diagram of components included in the present invention.

Generally speaking, the present invention provides a method for adapting a standard typewriter keyboard 10, an example of which is shown in FIG. 1A, to replace a standard piano-style keyboard 12, an example of which is shown in FIG. 1B, to control the production of music. In accordance with the method of the present invention, typewriter keyboard 10 rather than, or optionally in addition to, piano keyboard 12 may be used to control the production of music by an electronic keyboard instrument 14, a block diagram of which is shown in FIG. 4. By substituting typewriter keyboard 10 for piano keyboard 12, a novice or amateur musician that is familiar with the layout and key location of keys on typewriter keyboard 10 may be more successful at playing music than he or she would be using piano keyboard 12. A typist may produce music by simply reading a musical score that represents notes and chords as individual alphanumeric characters.

Figure 2:
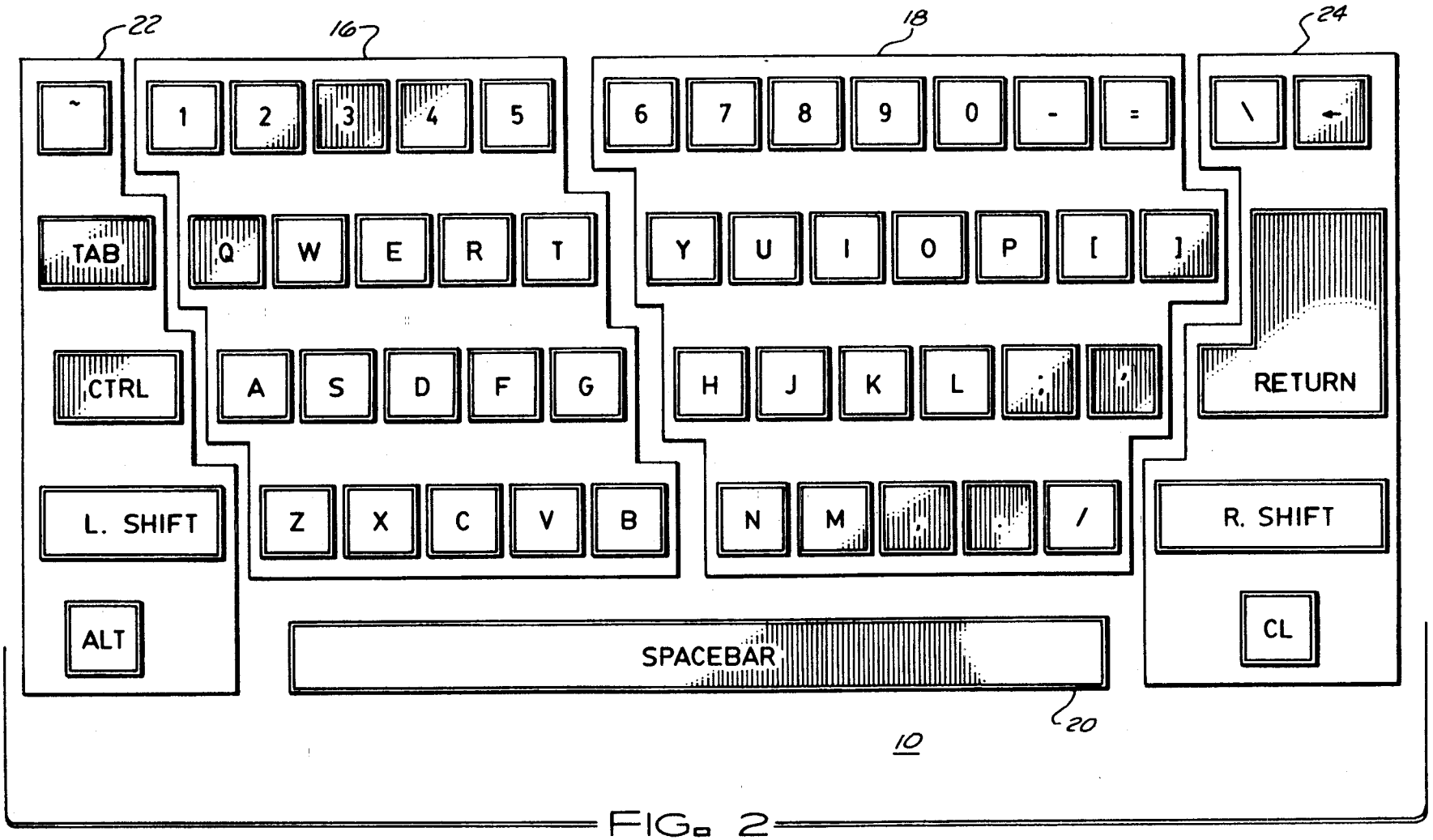
FIG. 2 shows various sets of keys included in the typewriter keyboard of the present invention.

FIG. 2 illustrates how typewriter keyboard 10 is partitioned into sets of keys or switches. Typewriter keyboard 10 is generally well known to vast numbers of persons. The preferred embodiment of the present invention utilizes a QWERTY keyboard, which is named after the alphabetic letters associated with certain adjacent keys included in keyboard 10. However, alternative keyboard layouts, such as the Dvorak layout, may be adapted into the method of the present invention by those skilled in the art.

Standard typewriter keyboard 10 includes five different sets of keys. Specifically keyboard 10 includes a left-hand set of keys 16, a right-hand set of keys 18, a spacebar key 20, a left set of control keys 22, and a right set of control keys 24. Left-hand set of keys 16, right-hand set of keys 18, and spacebar key 20, as shown in FIG. 2, are rigidly adhered to by various versions of QWERTY typewriter keyboards 10. While standard typewriter keyboards 10 almost always include left and right sets of control keys 22 and 24, the precise number, relative location, size, and functions or characters assigned to these keys may vary somewhat. In the preferred embodiment of the present invention, left set of control keys 22 includes at least 5 keys and right set of control keys 24 includes at least 3 keys. Many typewriter keyboards 10 include additional keys, which are not shown in FIGS. 1A and 2. Such additional keys are not utilized in the preferred embodiment of the present invention because their precise locations are not generally well known to typists without first looking.

Left-hand set of keys 16 are ergonomically positioned on typewriter keyboard 10 to be conveniently and quickly pressed or activated by the fingers of a user's left hand. Likewise, right-hand set of keys 18 are ergonomically positioned on typewriter keyboard 10 to be conveniently and quickly activated by the fingers of a user's right hand. Naturally, right-hand set of keys 18 are located to the right of left-hand set of keys 16. Each of sets 16 and 18 include four rows of keys. In standard touch typing usage, a users fingers rest on the "home" row, which includes keys "A", "S", "D", and "F" from left-hand set 16 for the user's left hand and keys "J", "K", "L", and ";" from right-hand set 18 for the user's right hand. From this home position, a user's fingers may quickly activate keys in the home row, either one or two rows above the home row, and one row below the home row. In standard touch typing usage, a user's left hand fingers do not activate keys in right-hand set 18, and a user's right hand fingers do not activate keys in left-hand set 16.

In accordance with standard touch typing usage, the "6" key may sometimes be associated with left-hand set of keys 16. However, in a standard typewriter keyboard 10, the "6" key would thus be the right-most key in left-hand set 16. For reasons discussed below, the "6" key is included in right-hand set of keys 18 in the present invention so that it becomes the left-most key in right-hand set 18. Due to its placement, it can be reached by the index finger of a user's right hand with approximately the same ease as with the index finger of a user's left hand. Due to the placement of the "6" key, left-hand set of keys 16 includes 20 keys and right-hand set of keys 18 includes 25 keys.

As is conventional, spacebar key 20 resides below both left-hand and right-hand sets 16–18. Spacebar 20 is ergonomically positioned to be easily and quickly operated with the thumb from either of a user's right or left hand.

Figure 3:
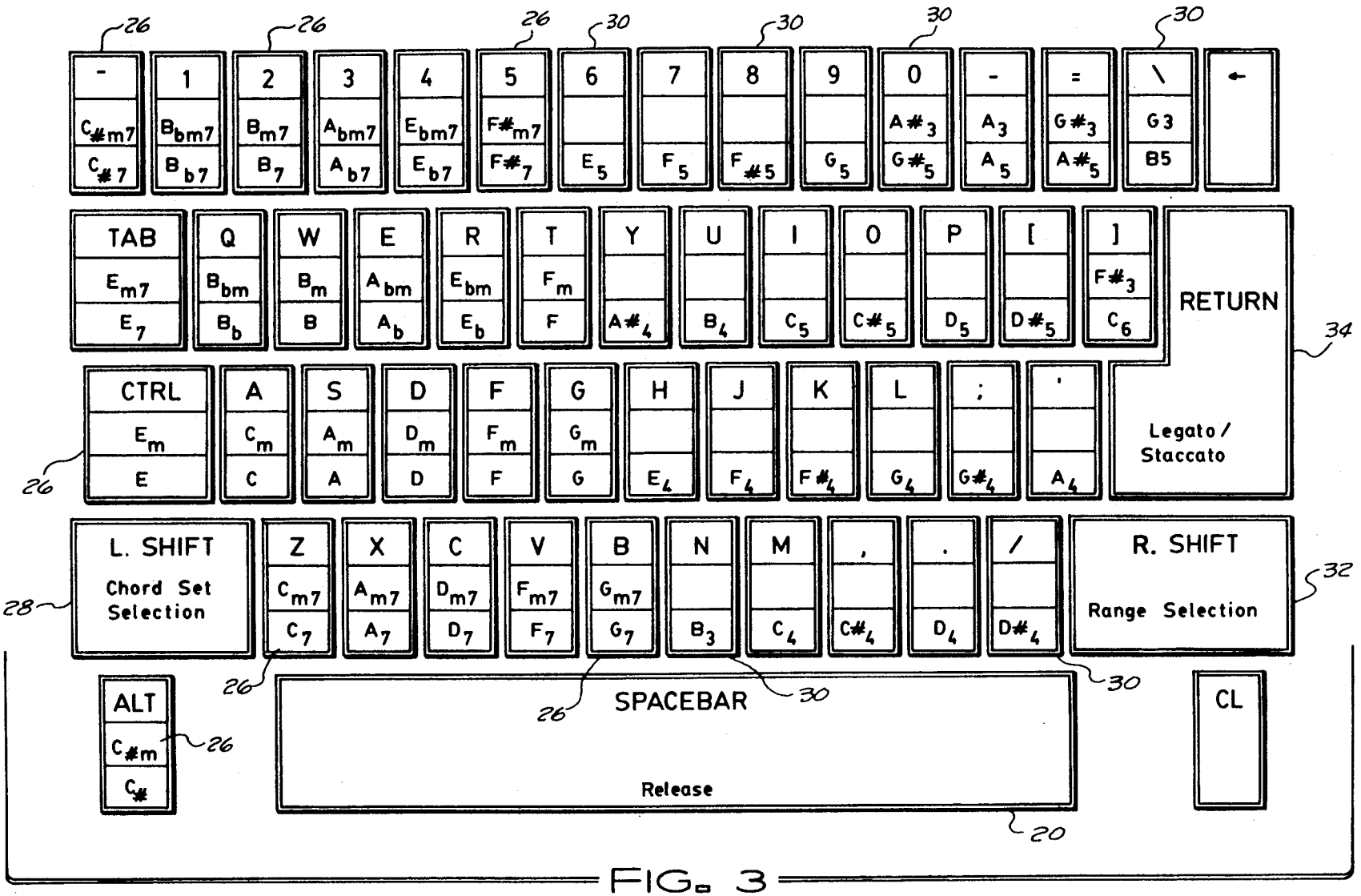
FIG. 3 shows a preferred method of associating specific chords and melody notes with corresponding keys of the keyboard of the present invention.

The present invention assigns specific musical sounds to the various keys of typewriter keyboard 10, as shown in FIG. 3. Those skilled in the art will recognize that the notations listed in FIG. 3 indicate particular musical notes and chords which are associated with particular keys and key combinations of a piano-style keyboard, such as that shown in FIG. 1B.

In particular, the method of the present invention assigns musical notes to accommodate a typist's tendency to press only a single key on typewriter keyboard 10 at a time. This tendency is accommodated by assigning specific chord sounds to single keys. In addition, the method of the present invention separates chord keys from melody note keys so that chord keys are preferably activated only by a user's left hand while melody note keys are preferably activated only by a user's right hand. A typist finds separately and simultaneously controlling two fingers on two hands to be much less awkward than separately and simultaneously controlling two fingers on the same hand. Therefore, to the extent that a musical score may call for a chord and melody note to be initiated at approximately the same time, the assignment scheme of the present method does not seem awkward to a typist.

For the purposes of the present invention, chords are defined as a combination of at least two concurrently sounded single notes. However, as is conventional, chord keys in the preferred embodiment of the present invention control instrument 14 (see FIG. 4) so that three or more single notes are combined. Those skilled in the art will appreciate that 48 chords are recognized, and the preferred embodiment of the present invention allows a user to play any of all 48 chords using only his or her left hand.

As discussed above, left-hand set of keys 16 (see FIG. 2) includes 20 keys and left control key set 22 includes at least five keys. Forty-eight chords are produced by multiplexing each of the 20 keys included in left-hand set of keys 16 and four of the keys included in left control key set 22 to produce one of two possible chords each. These multiplexed keys are referred to as chord keys 26 hereinbelow. Another key from left control key set 22, preferably the left shift key 28, specifies which of the two chords to sound for each chord key.

Thus, a single left hand keystroke produces any one of 24 of the 48 chords, and a single left hand keystroke combined with manipulation of left shift key 28 produces any one of another 24 of the 48 chords. The operation of left shift key 28 is natural for a typist. Moreover, in the preferred embodiment of the method of the present invention, left shift key 28 need not be activated simultaneously with a chord key 26, but may be activated prior to the activation of a chord key 26. As a result, a typist generates chords with the typist's left hand only by "typing" what would otherwise be considered lower and upper case letters, and the like. Moreover, as discussed below in connection with FIG. 6, once a chord sound has been initiated, the present invention latches or continues the sound until another chord is initiated. Thus, a typist may continue the typist's tendency to deactivate a key once it has been activated, rather than keeping his or her finger on a chord key 26.

FIG. 3 specifies the specific chords that are associated with each of chord keys 26 in the preferred embodiment of the present invention. Preferably, the more frequently used chords are associated with a chord key 26 without operation of left shift key 28, and the more infrequently used chords are associated with a chord key 26 in combination with left shift key 28. However, those skilled in the art will recognize that the precise associations are largely arbitrary and may be altered.

The method of the present invention associates single notes, as opposed to chords, to keys in typewriter keyboard 10 that are typically activated by a user's right hand. It has been empirically determined that a vast majority of popular music is played using melody notes that are confined to within around two octaves. Accordingly, the preferred embodiment utilizes 26 melody note keys 30 to produce 31 distinct single melody notes. Hence, the melody notes of the present invention span almost three octaves. Melody note keys 30 include the 25 above-discussed keys included in right-hand set of keys 18 (see FIG. 2) along with one key from right set of control keys 24. As discussed above, melody note keys 30 include the "6" key of a conventional QWERTY keyboard.

The 26 melody note keys 30 are associated with 31 melody notes by multiplexing five of melody note keys 30. In the preferred embodiment, these five keys are the "0", "–", "=", and "]" keys from right-hand set of keys 18 (see FIG. 2), and one key used from right set of control keys 24, shown as key "\" in FIGS. 2–3. The remaining 21 keys are not multiplexed. In a manner similar to that discussed above for chord keys 26, the multiplexed melody note keys 30 are controlled by operation of the right shift key 32, included in the right set of control keys 24 (see FIG. 2). In particular, when right shift key 32 has not been manipulated, these multiplexed melody note keys 30 are associated with melody notes having tones which are higher in pitch than the tones associated with the non-multiplexed melody note keys 30, as shown in FIG. 3. When the right shift key 32 has been manipulated, these multiplexed melody note keys 30 are associated with melody notes having tones that are lower in pitch than the tones associated with the non-multiplexed melody note keys 30, as shown in FIG. 3.

In the preferred embodiment of the present method, right shift key 32 is latched so that instrument 14 (see FIG. 4) remembers a previous manipulation of right shift key 32 and operates melody note keys 30 in one of two 26 note ranges. Accordingly, for most popular music a typist need not operate right shift key 32 while playing, but may manipulate right shift key 32 prior to performing a song. The multiplexed melody note keys 30 will either extend the range of the non-multiplexed melody note keys 30 or produce tones lower in pitch that the non-multiplexed melody note keys 30.

In addition, the preferred method of the present invention operates in two modes for silencing melody note sounds that have been initiated. Instrument 14 (see FIG. 4) toggles between these two modes through manipulation of RETURN key 34, located near melody note keys 30 on the right side of typewriter keyboard 10. In a legato mode, the melody notes are latched and continue to sound after a typist deactivates a melody note key 30. The sound continues until another melody note key 30 is activated or until spacebar 20 is activated. When the same melody note key 30 is reactivated, a short momentary silence occurs to distinguish a subsequent melody note from a previous one. In a staccato mode, the sound is silenced immediately after a typist deactivates a melody note key 30.

The staccato mode of operation actually gives a typist more control over the sound produced by instrument 14 (see FIG. 4). However, the duration of melody notes is controlled by the length of time each melody note key 30 remains activated or pressed. This is not a natural mode of operating a typewriter keyboard for most typists. Accordingly, the legato mode permits a typist to operate a typewriter keyboard in a normal fashion, in which melody note keys 30 are deactivated immediately after they are activated. By using the legato mode, a less choppy and more pleasing sound results when a typist uses the natural immediate key deactivation technique endemic to typing.

FIG. 3 specifies the specific melody notes that are associated with each of melody note keys 30 in the preferred embodiment of the present invention. Middle C ($C_4$) is associated with the "M" key. As shown in FIG. 3, the preferred method increases pitch as non-multiplexed melody note keys 30 from left-to-right and bottom-to-top are activated. This logical progression aids in associating melody note tones with key positions. However, those skilled in the art will recognize that the precise associations are largely arbitrary and may be altered.

FIG. 4 shows a block diagram of components included in a preferred electronic keyboard instrument 14 that performs the method of the present invention. Specifically, instrument 14 includes an electronic sound generation platform 36 and optionally includes piano-style keyboard 12. In the preferred embodiment, platform 36 and keyboard 12 are both provided by a CASIO MT-100 electronic keyboard which is commercially available. However, the method of the present invention is by no means limited to being practiced on this particular electronic keyboard. Numerous styles of conventional electronic keyboard instruments and platforms may be constructed or easily adapted to practice the present invention. In addition, those skilled in the art may adapt a conventional computer to practice the method of the present invention using a computer keyboard.

Keyboard 12 couples to platform 36 through a multiplicity of pairs of conductors 38. Each pair of conductors 38 couples to its own key or switch 40 (see FIG. 1B). When a key 40 is activated, the corresponding pair 38 is shunted, and platform 36 produces a sound in response to the key activation. Platform 36 may advantageously include switches (not shown) other than those included on keyboard 12. These other switches may control various modes of operating platform 36. Such switches and modes of operating platform 36 may be used with the method of the present invention. Keyboard 12 is optional for the purposes of the present invention. If keyboard 12 is included, then music may be played using either keyboard 12, typewriter keyboard 10, or both.

Each of pairs 38 couples to a typewriter keyboard interface 42, which is discussed below in connection with FIGS. 5–6. Hence, interface 42 provides switching which couples in parallel to piano keyboard 12, if utilized. Interface 42 also couples to each of the multiplicity of individual keys or switches included in typewriter keyboard 10 and discussed above in connection with FIGS. 2–3. FIG. 4 illustrates a typewriter keyboard 10 that is configured to provide a single, individual output node for each switch included in typewriter keyboard 10. Additional nodes for each switch included in typewriter keyboard 10 couple together and to a node 46. In the preferred embodiment, a positive voltage is applied to node 46, and this positive voltage appears at the output node of each switch that is then-currently activated.

While FIG. 4 shows one specific electrical configuration for typewriter keyboard 10, those skilled in the art will recognize that other electrical configurations may also be utilized in connection with the present invention. For example, many conventional typewriter keyboards 10 deploy their switches in a matrix pattern in which columns of switches are individually energized and rows of switches are scanned to detect activated switches. Moreover, many typewriter keyboards 10 that are used in connection with computers tend to include controller circuitry which automatically performs such individual energizing and scanning functions, switch debouncing, and repeat key functions. Such computer typewriter keyboards 10 provide output codes on a data bus that identifies a single activated key. These and other typewriter keyboard 10 configurations are intended to fall within the scope of the present invention.

Figure 5:
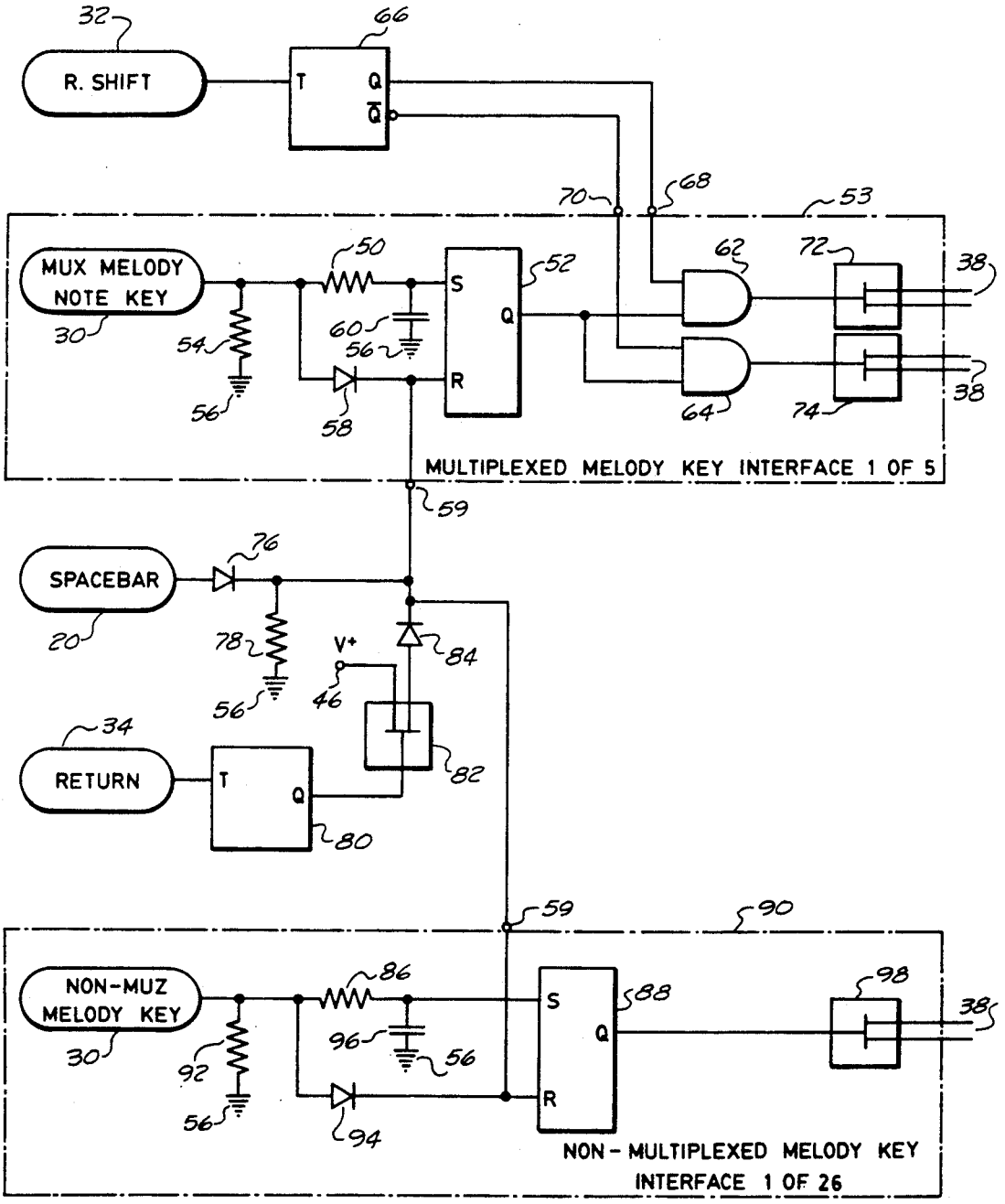
FIG. 5 shows a block diagram of a melody key interface portion of a typewriter keyboard interface component of the present invention.

FIG. 5 shows a block diagram of melody circuits 48 within typewriter keyboard interface 42. Melody circuits 48 adapt melody note keys 30 for application to platform 36 (see FIG. 3). Specifically, each of multiplexed melody note keys 30 couples, at the output thereof (see FIG. 4), through a series resistor 50 to a set input of an S-R latch circuit 52 of its own multiplexed melody key interface 53. Since the preferred embodiment includes five multiplexed melody note keys 30, it likewise includes five interfaces 53, each of which is configured substantially as shown in FIG. 5. The key 30 also couples through a pull-down resistor 54 to a node 56, which is adapted to receive a common potential such as ground, and through a steering diode 58 to a reset input of S-R latch 52. The reset input of S-R latch 52 also couples to a latch release node 59, which is discussed in more detail below. The set input of S-R latch 52 also couples to ground terminal 56 through a capacitor 60. A Q output of S-R latch 52 couples to first inputs of AND elements 62 and 64.

Right shift key 32 couples to a T input of a trigger or toggle flip-flop circuit 66, whose output changes state each time its T input is raised to a positive voltage. Q and Q-not outputs of flip-flop 66 couple to multiplexed melody key interface 53 at nodes 68 and 70, respectively. Nodes 68 and 70 couple to second inputs of AND elements 62 and 64, respectively, and outputs of AND elements 62 and 64 couple to control inputs of electronic switches 72 and 74, respectively. The switched nodes of switches 72 and 74 couple to their own corresponding ones of pairs 38 (see FIG. 4). The corresponding ones of pairs 38 are defined through the associations presented in FIG. 3. For example, in connection with the chord key 30 labeled "0" in typewriter keyboard 10, switches 72 and 74 couple to the pairs 38 that cause electronic platform 36 to generate the $A\#_3$ and $G\#_5$ notes (see FIGS. 3 and 5).

Spacebar 20 couples through a steering diode 76 to release node 59. A pull-down resistor 78 couples between release node 59 and ground node 56. In addition, return key 34 couples to a T input of a toggle flip-flop circuit 80, and a Q output of flip-flop circuit 80 couples to a control input of an electronic switch 82. A first node of switch 82 couples to positive voltage node 46, and a second node of switch 82 couples through a steering diode 84 to release node 59.

Each of non-multiplexed melody note keys 30 couples, at the output thereof (see FIG. 4), through a series resistor 86 to a set input of an S-R latch circuit 88 of its own non-multiplexed melody key interface 90. Since the preferred embodiment includes 21 non-multiplexed melody note keys 30, it includes 21 interfaces 90, each of which is configured substantially as shown in FIG. 5. The non-multiplexed key 30 also couples through a pull-down resistor 92 to ground node 56 and through a steering diode 94 to a reset input of S-R latch 88. The reset input of S-R latch 88 also couples to latch release node 59. The set input of S-R latch 88 also couples to ground terminal 56 through a capacitor 96. A Q output of S-R latch 88 couples to a control input of an electronic switch 98, and switched nodes of switch 98 couple to their own corresponding ones of pairs 38 (see FIG. 4). The corresponding ones of pairs 38 are defined through the associations presented in FIG. 3.

S-R latches 52 and 88 are preferably NOR-gate latches with inverted outputs, which have a truth table as follows:

| S | R | O |
|---|---|---|
| 0 | 0 | No Change |
| 0 | 1 | 0 |
| 1 | 0 | 1 |
| 1 | 1 | 1 |

Hence, when a melody key 30 is activated or pressed, its corresponding S-R latch 52 or 88 is set to a high level. For non-multiplexed melody key interfaces 90, switch 98 goes to a low impedance state, and pair 38 is shunted. This causes platform 36 (see FIG. 4) to initiate and produce a corresponding melody note. For multiplexed melody key interfaces 53, when latch 52 is set to a high level, one of switches 72 and 74 goes to a low impedance state. The selected one of switches 72 and 74 is determined by the state of flip-flop 66, which is responsive to the operation of right shift key 32. Thus, platform 36 produces either a high note or a low note, as discussed above, when one of multiplexed melody note keys 30 is activated.

Whether a sound initiated by the activation of a melody key 30 continues or not depends on the state of release node 59. If release node 59 is low, due to the operation of resistor 78, then latches 52 and/or 88 remain latched so that the sound continues. The sound will cease when a melody note key 30 has been deactivated and release node 59 goes to a high level. Release node 59 goes high when the operational mode recorded in flip-flop 8 indicates the staccato mode of operation, discussed above in connection with FIG. 3. Alternatively, spacebar 20 or any other melody note key 30 may activate to cause release node 59 to go to a high level.

A special situation occurs when a melody note key 30 is reactivated after being deactivated while operating in the legato mode. Without the inclusion of the R-C circuits formed by resistor 50 and capacitor 60 or resistor 86 and capacitor 96, the reactivation would not be recognized. Rather, the sound initiated by the prior activation of the melody note key 30 would continue without any noticeable modification caused by the reactivation of the key 30. However, these R-C circuits cause the set inputs of S-R latches 52 and 88 to reach a high level more slowly than the reset inputs upon activation of a melody note key 30. Consequently, latches 52 and 88 are initially reset upon activation of a melody note key 30, then set as soon as capacitors 60 and 96 charge. The R-C circuits are preferably configured so that the set input is recognized by latches 52 and 88 around 25–150 msec, and more preferably around 70 msec, after latches 52 and 88 are reset. As a result, when a melody note key 30 is reactivated after being deactivated while operating in the legato mode, a 25–150 msec. silence period is inserted into an otherwise continuous sound, and distinct notes can be recognized.

Figure 6:
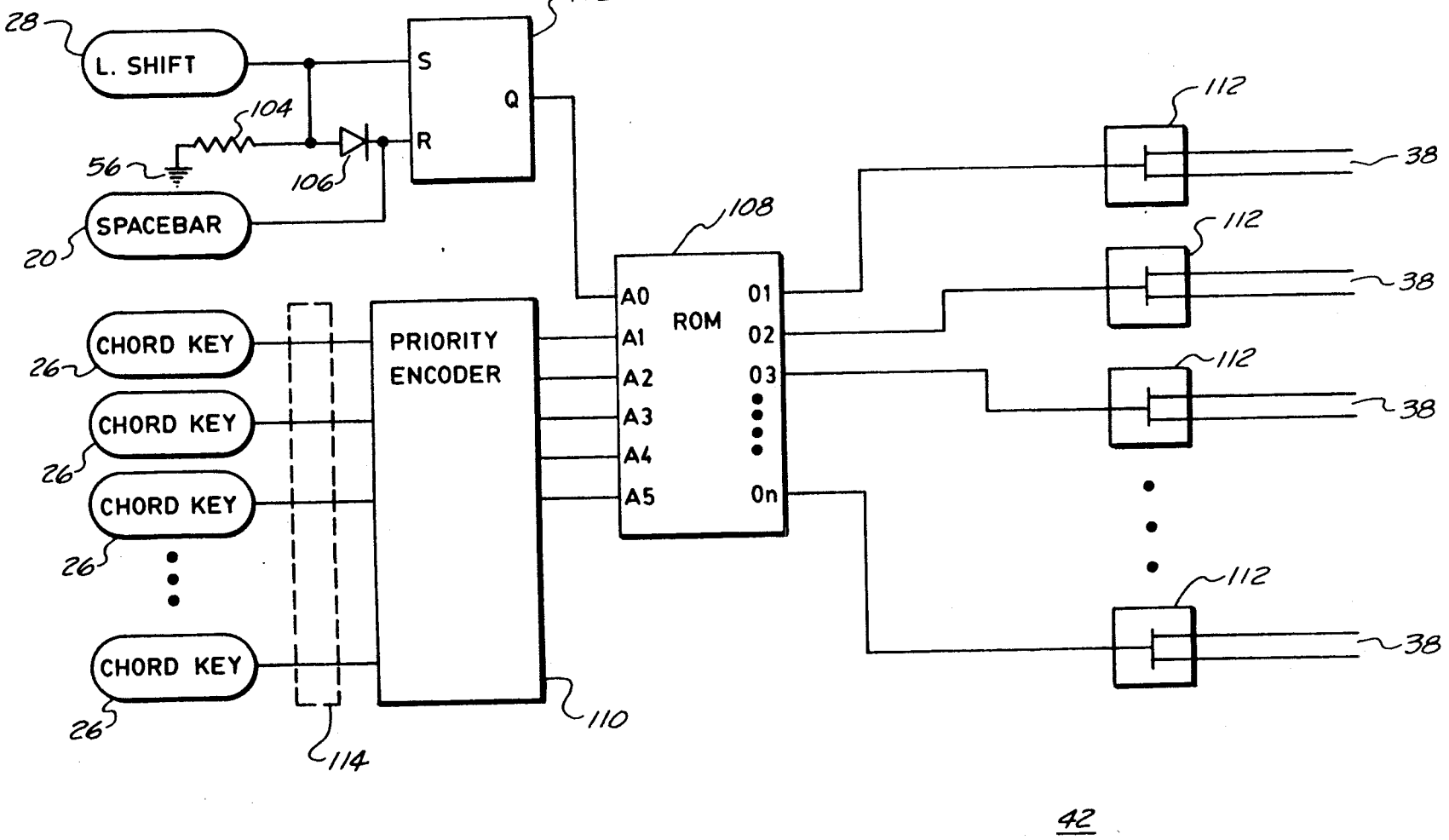
FIG. 6 shows a block diagram of a chord key interface portion of the typewriter keyboard interface component of the present invention.

FIG. 6 shows a block diagram of chord circuits 100 within typewriter keyboard interface 42. Chord circuits 100 adapt chord keys 26 for application to platform 36 (see FIG. 3). Specifically, left shift key 28 couples to a set input of an S-R latch 102, which operates as discussed above. The set input of S-R latch 102 additionally couples to ground node 56 through a pull-down resistor 104 and to a reset input of S-R latch 102 though a steering diode 106. Spacebar 20 also couples to the reset input of S-R latch 102. A Q output of latch 102 couples to a first address input (A0) of a read-only-memory (ROM) circuit 108. Each of chord keys 26 couples to a corresponding input of a priority encoding circuit 110. Outputs of encoding circuit 110 couple to second through sixth inputs (A1–A5) of ROM circuit 108. Outputs of ROM circuit 108 couple to control inputs of corresponding electronic switches 112. The switched nodes of switches 112 couple to their own corresponding one of pairs 38.

As discussed above, the preferred embodiment of the present invention uses a specific CASIO MT-100 electronic keyboard as platform 36 (see FIG. 4). This platform 36 is configured to have eighteen chord keys 40 (see FIG. 1B). Accordingly, eighteen of pairs 38 are used for playing chords. Eighteen chords are produced as a result of activating any single one of these eighteen keys 40. Additional chords are produced by simultaneously activating combinations of the eighteen chord keys 40. Accordingly, the preferred embodiment utilizes a ROM circuit 108 having eighteen outputs and eighteen of switches 112. Encoder 110 encodes an activated chord key 26 into a 5 bit code that identifies a single activated chord key 26. ROM 108 is programmed in a manner known to those skilled in the art to shunt the appropriate combinations of pairs 38 so that the chords listed in FIG. 3 are produced in response to activations of chord keys 26. Latch 102 records an operation of left shift key 28 to select one of two multiplexed chords for each chord key 26, as discussed above. Operation of spacebar 20 removes the shift latch function.

In the preferred embodiment, platform 36 has an autochord feature which automatically latches chord key activations so that chord sounds continue after their initiation until a subsequent chord key combination is activated. Accordingly, interface circuits 100 need not include circuits to perform this function. However, in conjunction with alternate embodiments of platforms 36 that might not include this auto chord feature, latching circuits 114, which are similar to those discussed above in connection with FIG. 5, may advantageously be included between chord keys 26 and encoder 110.

In addition, if an alternate embodiment typewriter keyboard 10 is used in which keyboard outputs are key codes or matrix addresses, then encoder 110 may be omitted. Likewise, ROM 108 may be replaced by a matrix of steering diodes which steer each single typewriter keyboard 10 key activation to the corresponding pairs 38 to produce particular chord key combinations. Moreover, if platform 36 does not provide an individual chord key function, the number of outputs from ROM 108 and the corresponding number of switches 112 may be increased to equal the number of single tone sounds producible by platform 36. In this situation, various ones of switches 112 may be coupled in parallel with switches 72, 74, and 98, discussed above in connection with FIG. 5.

In summary, the present invention provides an improved method of adapting a typewriter keyboard to produce music. The present method calls for activating only single keys of a typewriter keyboard to produce any one of 48 chords. Accordingly, a typist need not simultaneously activate multiple keys to produce chords. The present method produces chord sounds in response to the activation of keys located on one side of a typewriter keyboard and melody notes in response to the activation of keys located on the other side of the typewriter keyboard. Thus, a typist need not be faced with the awkwardness of attempting to activate a chord and a melody note with the fingers of a single hand. The present method continues sounds initiated in response to activation of a typewriter keyboard key after the key has been deactivated. Thus, a typist may successfully produce pleasant sounding music by following a typist's natural tendency to deactivate a typewriter keyboard key immediately after it has been activated. In addition, a typist who is not a touch typist may successfully utilize the present invention to produce music because the latching of sounds affords the typist time to find the next key to activate.

The present invention has been described above with reference to preferred embodiments. However, those skilled in the art will recognize that changes and modifications may be made in these preferred embodiments without departing from the scope of the present invention. For example, numerous types and styles of platform 36 may be adapted to perform the method of the present invention. This includes platforms 36 which are operated under the control of personal computers. In addition, various typewriter keyboards may use a mechanical latch to perform some of the latching functions described herein as being performed by electronic latches. These and other changes and modifications which are obvious to those skilled in the art are intended to be included within the scope of the present invention.

What is claimed is:

1. A method of emitting tones in response to the activation of keys included in a typewriter keyboard having a first set of keys ergonomically placed for operation by a first hand and a second set of keys ergonomically placed for operation by a second hand, said first and second sets of keys each having said keys thereof positioned within four rows wherein each of said rows includes a plurality of said keys, said method comprising the steps of:

monitoring said keys included in said first-hand and second-hand sets of keys to detect activations and deactivations thereof;

generating a chord, which results from a combination of at least two of said tones, when said monitoring step detects activation of any key from said first-hand set of keys; and producing a melody note, which represents a single one of said tones, when said monitoring step detects activation of any key from said second-hand set of keys.

2. A method as claimed in claim 1 wherein:

said typewriter keyboard additionally has a control key;

said method additionally comprises the step of multiplexing at least a portion of said first-hand set of keys so that each multiplexed key of said first-hand set of keys has two chords associated therewith; and said generating step comprises, when one of said multiplexed keys has been activated, the step of selecting one of said associated two chords for generation, said selection being responsive to manipulation of said control key.

3. A method as claimed in claim 1 wherein said keyboard has a spacebar in addition to said first-hand and second-hand sets of keys, and said generating step additionally comprises the steps of:

continuing said chord after said key from said first-hand set of keys is deactivated; and silencing said chord when any other key from said first-hand set of keys is activated.

4. A method as claimed in claim 1 wherein said first-hand set of keys includes at least 20 left-hand keys of said typewriter keyboard, and said second-hand set of keys includes at least 24 right-hand keys of said typewriter keyboard.

5. A method as claimed in claim 4 wherein:

said typewriter keyboard is configured as a QWERTY keyboard;

said generating step generates said chord in response to activation of any one of "1", "2", "3", "4", "5", "Q", "W", "E", "R", "T", "A", "S", "D", "F", "G", "Z", "X", "C", "V", and "B" keys; and said producing step produces said melody note in response to activation of any one of "7", "8", "9", "0", "–", "=", "Y", "U", "I", "0", "P", "H", "J", "K", "L", "N", "M", ",", and "." keys.

6. A method as claimed in claim 1 wherein said producing step additionally comprises the steps of:

continuing said melody note after said key from said second-hand set of keys is deactivated; and silencing said melody note when any other key from said second-hand set of keys is activated.

7. A method as claimed in claim 6 wherein said producing step additionally comprises the step of momentarily silencing said melody note when said key from said second-hand set of keys is re-activated after being deactivated in said continuing step.

8. A method as claimed in claim 7 additionally comprising the step of extending said momentary silencing step for an interval of between 25 msec and 150 msec.

9. A method as claimed in claim 1 wherein said keyboard has a spacebar key in addition to said first-hand and second-hand sets of keys, and said producing step additionally comprises the steps of:

continuing said melody note after said key from said second-hand set of keys is deactivated; and silencing said melody note when said spacebar key is activated.

10. A method as claimed in claim 1 wherein said typewriter keyboard additionally has a control key, and said method additionally comprises the steps of:

switching between first and second modes of operation by manipulating said control key;

when operating in said first mode of operation, continuing said melody note after said key from said second-hand set of keys is deactivated; and when operating in said second mode of operation, silencing said melody note in response to deactivation of said key from said second-hand set of keys.

11. A method as claimed in claim 1 wherein:

said typewriter keyboard additionally has a control; key;

said method additionally comprises the step of multiplexing a portion of said second-hand set of keys so that each of a predetermined number of said keys included in said second-hand set of keys has two melody notes associated therewith; and said producing step comprises, when one of said multiplexed keys is activated, the step of selecting one of said associated two melody notes for production, said selection being responsive to manipulation of said control key.

12. A method as claimed in claim 11 wherein said typewriter keyboard additionally has a "SHIFT" key located near said second-hand set of keys, and said method additionally comprises the step of monitoring said "SHIFT" key so that said "SHIFT" key serves as said control key.

13. A method as claimed in claim 11 wherein:

said second-hand set of keys includes non-multiplexed keys in addition to said multiplexed keys, each of said non-multiplexed keys having its own unique tone associated therewith; and said method additionally comprises the step of associating first and second melody notes with each of said multiplexed keys, each of said first melody notes having a lower tone than said tones associated with said non-multiplexed keys, and each of said second melody notes having a higher tone than said tones associated with said non-multiplexed keys.

14. A method of producing tones in response to the activation of keys included in a typewriter keyboard having a first-hand set of keys and a second-hand set of keys, said first-hand and second-hand sets of keys each having said keys thereof positioned within four rows wherein each of said four rows includes a plurality of said keys, and said method comprising the steps of:

monitoring said keys included in said first-hand and second-hand sets of keys for activations and deactivations thereof;

generating a chord, which results from a combination of at least two of said tones, when any key from said first-hand set of keys is activated;

initiating a melody note, which represents a single one of said tones, when any key from said second-hand set of keys is activated; and continuing said melody note after said key from said second-hand set of keys is deactivated.

15. A method of producing tones in response to the activation of keys included in a typewriter keyboard as claimed in claim 14 additionally comprising the step of silencing said melody note when any other key from said second-hand set of keys is activated.

16. A method of producing tones in response to the activation of keys included in a typewriter keyboard as claimed in claim 15 additionally comprising the step of momentarily silencing said melody note when said key from said second-hand set of keys is re-activated after being deactivated in said continuing step.

17. A method of producing tones in response to the activation of keys included in a typewriter keyboard as claimed in claim 14 wherein said keyboard has a spacebar key in addition to said first-hand and second-hand sets of keys, and said method additionally comprises the step of silencing said melody note when said spacebar key is activated.

18. A method of producing tones in response to the activation of keys included in a typewriter keyboard as claimed in claim 14 wherein:

said typewriter keyboard additionally has a control key;

said method additionally comprises the step of multiplexing a portion of said second-hand set of keys so that each of a predetermined number of keys from said second-hand set of keys has two melody notes associated therewith; and said initiating step comprises, when one of said multiplexed keys is activated, the step of selecting one of said associated two melody notes for initiation, said selection being responsive to manipulation of said control key.

19. A method of producing tones in response to the activation of keys included in a typewriter keyboard as claimed in claim 18 wherein:

said second-hand set of keys includes non-multiplexed keys in addition to said multiplexed keys, each of said non-multiplexed keys having its own unique tone associated therewith; and said method additionally comprises the step of associating first and second melody notes with each of said multiplexed keys, each of said first melody notes having a lower tone than said tones associated with said non-multiplexed keys, and each of said second melody notes having a higher tone than said tones associated with said non-multiplexed keys.

20. A method of producing tones in response to the activation of keys included in a typewriter keyboard as claimed in claim 14 wherein:

said typewriter keyboard additionally has a control key;

said method additionally comprises the step of multiplexing at least a portion of said first-hand set of keys so that each multiplexed key of said first-hand set of keys has two chords associated therewith; and said generating step comprises, when one of said multiplexed keys has been activated, the step of selecting one of said associated two chords for generation, said selection being responsive to manipulation of said control key.

21. A method of producing tones in response to the activation of keys included in a typewriter keyboard as claimed in claim 14 wherein:

said keyboard is configured as a QWERTY keyboard;

said generating step generates said chord in response to activation of any one of "1", "2", "3", "4", "5", "Q", "W", "E", "R", "T", "A", "S", "D", "F", "G", "Z", "X", "C", "V", and "B" keys; and said initiating step initiates said melody note in response to activation of any one of "7", "8", "9", "0", "–", "=", "Y", "U", "I", "O", "P", "H", "J", "K", "L", "N", "M", ",", and "." keys.

22. A method of producing tones in response to the activation of keys included in a typewriter keyboard having a first-hand set of keys, a second-hand set of keys, and first and second control keys, said method comprising the steps of:

multiplexing at least a portion of said first-hand set of keys so that multiplexed keys from said first-hand set of keys have first and second chords associated therewith, each of said chords resulting from a combination of at least two of said tones;

multiplexing a portion of said second-hand set of keys so that multiplexed keys from said second-hand set of keys have first and second melody notes associated therewith and so that non-multiplexed keys from said second-hand set of keys have one melody note associated therewith, each of said melody notes representing a single one of said tones;

monitoring said keys of said typewriter keyboard for activations and deactivations thereof;

when one of said multiplexed chord keys is activated, selecting one of said associated first and second chords, said chord selection being responsive to manipulation of said first control key;

generating said selected chord;

when one of said multiplexed melody keys is activated, selecting one of said associated first and second melody notes, said melody note selection being responsive to manipulation of said second control key;

when one of said non-multiplexed melody keys is activated, selecting said one melody note associated therewith;

initiating said selected melody note;

continuing said initiated melody note after said activated key from said second-hand set of keys is deactivated.

23. A method as claimed in claim 22 additionally comprising the step of silencing said initiated melody note when another key from said second-hand set of keys is activated.

24. A method as claimed in claim 23 additionally comprising the step of momentarily silencing said initiated melody note when said activated key from said second-hand set of keys is re-activated after being deactivated in said continuing step.

25. A method as claimed in claim 22 wherein said keyboard has a spacebar key in addition to said first-hand set, second-hand set, and first and second control keys, and said method additionally comprises the step of silencing said initiated melody note when said spacebar key is activated.

26. A method as claimed in claim 22 wherein said multiplexing said second-hand set of keys step comprises the steps of:

defining each of said first melody notes to have a lower tone than said tones associated with said non-multiplexed melody keys; and defining each of said second melody notes to have a higher tone than said tones associated with said non-multiplexed melody keys.

27. A method as claimed in claim 22 wherein:

said keyboard is configured as a QWERTY keyboard;

said generating step generates said selected chord in response to an activation of any one of "1", "2", "3", "4", "5", "Q", "W", "E", "R", "T", "A", "S", "D", "F", "G", "Z", "X", "C", "V", and "B" keys; and said initiating step initiates said selected melody note in response to activation of any one of "7", "8", "9", "0", "–", "=", "Y", "U", "I", "O", "P", "H", "J", "K", "L", "N", "M", ",", and "." keys.

* * * * *